United States Patent [19]

Sinha et al.

[11] Patent Number: 4,552,200

[45] Date of Patent: Nov. 12, 1985

[54] CONTROL IN CONTINUOUS CASTING TO ENHANCE FEEDING

[75] Inventors: Uday K. Sinha; Frank A. Peacock, both of Carrollton, Ga.

[73] Assignee: Southwire Company, Carrollton, Ga.

[21] Appl. No.: 592,198

[22] Filed: Mar. 22, 1984

Related U.S. Application Data

[63] Continuation of Ser. No. 431,439, Sep. 30, 1982, abandoned, which is a continuation of Ser. No. 220,647, Dec. 29, 1980, abandoned.

[51] Int. Cl.[4] ..... B22D 11/16

[52] U.S. Cl. ..... 164/454; 164/482

[58] Field of Search ..... 164/482, 433, 434, 452–455

[56] References Cited

U.S. PATENT DOCUMENTS 3,596,702 8/1971 Ward ..... 164/482

*Primary Examiner*—Kuang Y. Lin

*Attorney, Agent, or Firm*—Herbert M. Hanegan

[57] ABSTRACT

A method is provided for optimally operating a wheel-type continuous caster such that solidification porosity and macrosegregation in the continuous strand thus produced is substantially minimized while casting speed is substantially maximized subject to that condition. Continuous casting is adjusted from an operational condition where solidification porosity is forming by changing the solidification rate so as to cause the terminus of the solidification zone to shift location in the direction of increasing metalostatic pressure until the point where solidification porosity ceases to form or its occurrence is minimized; further provided that in the vicinity of the solidification terminus the direction of increasing metalostatic pressure is maintained counter to the direction of casting. Conversely, from an operational condition where solidification porosity is not forming, solidification rate is changed so as to cause the solidification terminus to shift location in the direction of casting and in the direction of decreasing metalostatic pressure until formation of solidification porosity impends. Advantageously, this system may be utilized continuously to correct continually for perturbations during continuous casting. Additionally, the invention comprehends a continuously cast strand of indefinite length produced by the above method wherein macroscopic solidification porosity has been substantially eliminated and macrosegregation has been substantially minimized. This advance is especially important for alloys that are particularly susceptible to solidification bridging defects in casting, such as those alloys having a large freezing range.

7 Claims, 3 Drawing Figures

CONTROL IN CONTINUOUS CASTING TO ENHANCE FEEDING

This application is a continuation of application Ser. No. 431,439, filed Sept. 30, 1982, which is a continuation of application Ser. No. 220,647, filed Dec. 29, 1980, both now abandoned.

BACKGROUND OF THE INVENTION

This invention relates generally to control of a continuous casting process for minimization of solidification porosity and macrosegregation in the continuous strand thus produced and relates specifically to optimal operation of a wheel-type caster such that casting rate is substantially maximized subject to the foregoing condition.

Typically in traditional ingot casting, a solidification shrinkage cavity or pipe is formed upon complete solidification of the ingot extending from the top of the ingot down into the center of the ingot, especially when the molten alloy being cast is degassed, as is usual. This result is generally undesirable in that during subsequent rolling operations closure and welding of the cavity may be less than complete due to oxidation of the surface of the cavity.

By contrast, in continuous casting, formation of a shrinkage pipe is avoided due to the continuous feeding of molten alloy into the solidification zone, so long as feeding of molten alloy is sufficient for a given casting speed. However, if casting speed exceeds the feeding rate, then a continuous solidification pipe appears along the internal longitudinal axis of the strand.

The solidification zone or length in continuous casting may be conceptually visualized as a stationary converging tube or elongated cone extending into the advancing solidifying strand into which molten alloy continually flows and is progressively drawn off while flowing down the cone as the solidifying walls of the strand progressively build up. At the terminus or apex of the cone, the molten flow is exhausted upon solidification becoming complete at the point where the solidifying walls of the advancing strand merge. The length of this solidification zone will change with casting speed, e.g. as casting speed increases the zone is elongated. However, if casting speed is increased to the point where feeding is insufficient, there will occur feed starvation such that the solidification zone does not converge and an elongated void appears along th interval axis of the cast strand (i.e. the stream of molten alloy is depleted before "reaching" the solidification apex).

Even though continuous casting under proper operation eliminates the formation of a shrinkage pipe in the cast product, solidification porosity is typically found along the internal longitudinal axis of the strand. The term "solidification porosity" refers to the presence of discrete pores of macroscopic dimension internal to the cast strand. Such porosity is to be distinguished from pore formation arising from the evolution of dissolved gases upon solidification of molten alloy, which may be substantially eliminated by degassing the molten alloy prior to pouring. The presence of solidification porosity indicates the condition of discontinuous feeding occurring in the vicinity of the terminus of the solidification zone even though feed rate and casting speed are apparently matched, i.e. a nominal decrease in speed has no appreciable effect.

The occurrence of solidification porosity in a cast strand presents a two-fold disadvantage. First, the presence of porosity is objectionable per se in that closure & welding of the voids frequently is less than complete in subsequent rolling operations. Second, discontinuous feeding or feed starvation in the solidification terminus, as manifested by the occurrence of solidification porosity, promotes macrosegregation in the casting. The term 'macrosegregation' is used in the conventional sense to refer to compositional inhomogeneity across the cast section resulting from progressive enrichment of the molten alloy building in advance of the solidification front within the solidifying strand.

A significant advantage of continuous casting over ingot casting is that macrosegregation is substantially diminished since the solute enriched molten core is continually mixed with fresh feed of molten alloy at nominal solute concentration, provided, however, that feeding is sufficient. Conversely, this advantage of continuous casting will not be fully realized if feeding is discontinuous as would be indicated by the presence of solidification porosity.

The present invention is especially concerned with wheel-type continuous casting (having a curvilinear mold) as opposed to linear-type continuous casting (having a linear mold). Typically, in wheel-type continuous casting, a stream of molten alloy is directed from a nozzle into a chill channel in the outer periphery of a vertically rotating casting wheel or ring, the channel being enclosed by a flexible band urged against and cooperatively rotating with the wheel periphery. The molten stream is continuously solidified within the channel into a cast strand which is correspondingly directed from an exit point in the channel to accumulating apparatus.

Specifically, the present invention is directed towards overcoming the aforementioned disadvantages associated with solidification porosity in a continuously cast strand by providing means to minimize or eliminate formation of solidification porosity in economic fashion. Restated, an optimum casting speed and cooling rate are determined such that casting speed in substantially maximized subject to the condition that solidification porosity is minimized or eliminated and macrosegregation is substantially minimized in the cast strand.

SUMMARY OF THE INVENTION

The mechanism giving rise to discontinuous feeding near the apex of the solidification zone in continuous casting, thereby giving rise to formation of solidification porosity, is believed to be attributable to the tendency for occurrence of solidification bridging. As used herein, the term "solidification bridging" refers to the intermeshing of dendrites extending from opposing planes or fronts of solidification within a casting as these opposing solidification fronts approach the center of the casting, i.e. as solidification nears completion. Thus, for feeding a molten alloy into the apex of the solidification zone through this meshed ,dendritic network, feeding pressure in the molten fluid must be sufficient to overcome this restriction to flow.

Accordingly, continuous casting using a wheel-type caster is adjusted from an operational condition where solidification porosity is forming by changing the solidification rate so as to cause the apex of the solidification zone to shift location in the direction of increasing metalostatic pressure until the point where solidification porosity ceases to form or its occurrence is minimized.

Casting parameters are initialized, and reinitialized in iterative fashion as necessary during the procedure, such that in the vicinity of the solidification apex the direction of increasing metalostatic pressure is maintained counter to the direction of casting. Conversely, from an operational condition where solidification porosity is not forming, the solidification rate is changed so as to cause the solidification terminus to shift location in the direction of casting until formation of solidification porosity impends.

By this control procedure, casting speed is optimally maximized. In addition to the economic advantage of operating at this maximum condition while suppressing formation of solidification porosity, there is the effect on macrosegregation. By increasing feeding rate (corresponding to increasing casting rate), mixing in the solidification zone and presentation of fresh molten alloy will be increased, thereby diminishing macrosegregation. Thus, by operating at a maximum rate, as defined above, macrosegregation will correspondingly be minimized.

In an especially advantageous mode, this system may be utilized continuously to correct continually for perturbations (random or intended) during continuous casting, e.g. perturbations in metalostatic head, coolant flow rate, alloying constituents, and the like. Furthermore, this procedure is generally applicable irrespective of the solidification bridging tendency of a given alloy.

Thus, in accordance with the invention, a method is provided for optimally operating a wheel-type continuous caster, such that solidification porosity and macrosegregation in the continuous strand thus produced is substantially minimized while casting rate is substantially maximized subject to said condition, comprising the steps:

(a) first, establishing operation of said caster at a condition of steady-state continuous casting, with cooling set at substantially maximum capacity;

(b) monitoring the location of the apex of the solidification zone within the solidifying strand being cast;

(c) if said solidification apex is not located downcourse of the 6 o'clock wheel position, then increasing casting speed until said condition is achieved;

(d) monitoring the presence of solidification porosity within said strand downcourse of said solidification apex;

(e) adjusting casting contitions according to the criteria:

(i) if porosity is present, decrease casting speed so as to shift said apex counter to the direction of casting and in the direction of increasing metalostatic pressure until formation of solidification porosity is substantially minimized; further provided that if said apex has been shifted substantially to the 6 o'clock wheel position without achieving said minimization, then decreasing cooling sufficiently to shift said apex downcourse of the 6 o'clock position by a selected distance and then repeating the procedure of this substep; or (ii) if porosity is not present, increase casting speed so as to shift said apex in the direction of casting until formation of porosity impends; and (f) maintaining casting conditions within a desired tolerance range about said adjusted conditions.

Additionally, the invention comprehends a continuously cast strand of indefinite length in the as-cast condition produced by the above method wherein macroscopic solidification porosity has been substantially eliminated and macrosegregation has been substantially minimized. This advance is especially important for alloys having a high susceptibility to solidification bridging, such as those alloys having a relatively large freezing range.

Thus, in accordance with the invention, there is provided a continuous strand of indefinite length characterized in the as-cast condition by the substantial absence of solidification porosity and minimum macrosegregation and further characterized as having been continuously cast using a wheel-type caster optimally operated at a substantially maximum casting rate, subject to said condition, according to the foregoing method. The term "minimum macrosegregation" is defined in detail below.

BRIEF DESCRIPTION OF THE DRAWINGS

Further details are given below with reference to the embodiments shown in the drawings, wherein.

DESCRIPTION OF THE PREFERRED EMBODIMENTS

Figure 1:
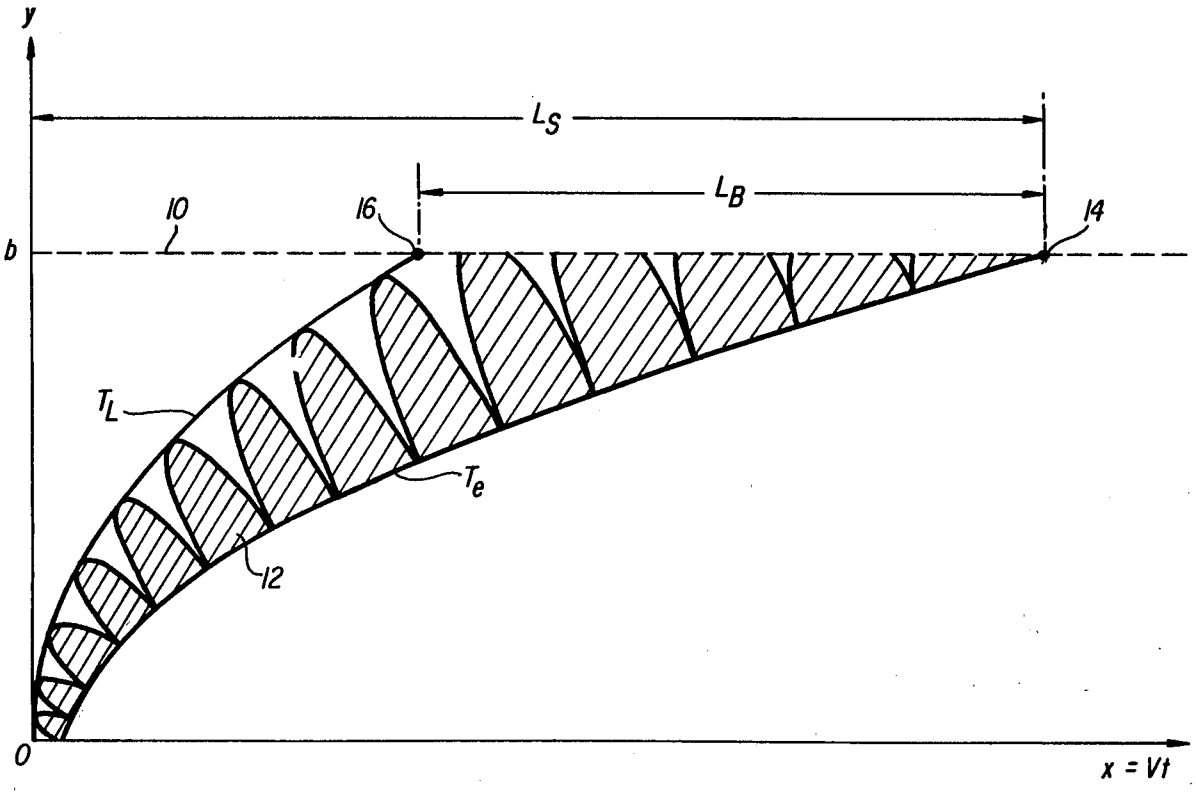
FIG. 1 schematically depicts a solidification zone within a moving solidifying strand during continuous casting, having a characteristic solidification profile.

Referring more particularly to the drawings, in FIG. 1, there is schematically depicted a characteristic solidification profile delimiting the solidification zone within a moving strand undergoing solidification during continuous casting. The illustration is both a depiction of the physical process of solidification within the strand and a mathematical graph of the solidification profile. The ordinate (y) represents lateral distance into the strand beginning from a surface location and extending toward the center of the strand, as indicated by centerline 10 having coordinate (b) equal to the half-width of the strand along this locus. The abscissa (x) represents longitudinal distance from the location of pouring in the direction of casting or, alternatively, represents elapsed time from pouring, since distance advanced is directly proportional to elapsed time (t), with the proportionality constant being casting speed (V). There are two isotherms plotted on this coordinate system, the liquidus temperature ($T_L$) and the solidus temperature ($T_e$) for the particular alloy being cast. The liquidus isotherm marks the location where all superheat has been extracted from the melt and where temperature drops into the freezing range. The solidus isotherm corresponds to the locus of the solidification front beyond which the alloy is completely solid and usually is significantly less than equilibrium solidus. Between the isotherms, both solid and liquid coexist with dendrites 12 (shown in exaggerated size) extending generally normal from the solidus into the melt toward the liquidus and growing from the melt to advance the solidification front. To emphasize the conical form of the solidification zone, the scale of the abscissa is greatly compressed relative to the half-thickness of the strand. To the observer whose point of reference is fixed within the moving strand, the solidification front appears to advance toward the center of the strand, while to the observer whose reference is fixed external to the strand, the solidification profile appears stationary so long as casting conditions are constant. The latter is the conventional manner of visualizing the process, with the abscissa given in units of time so that the solidus isotherm plots the time for complete solidification as a function of depth into the solidifying strand. As a general rule, the time to solidification at a given depth into the strand is substantially proportional to the square of such depth, reflecting a characteristic parabolic shape of the solidus.

The solidification length ($L_s$) is defined, for purposes herein, to be the distance from pouring (x=0) to the apex of the solidus at 14, as distinguished from the bridging length ($L_B$) being defined as that final segment of the solidification length where advancing dendrites of opposing solidification fronts merge and intermesh, or at least potentially so. The bridging length is seen to be the longitudinal distance between the apex of the liquidus at 16 and the apex of the solidus at 14. It is noted that this longitudinal axis of symmetry is, strictly speaking, the thermal centerline. However, when heat removal is substantially uniform about the transverse periphery of the strand, the thermal centerline substantially coextends with the geometric centerline, as depicted. Only one half of the transverse thickness of the solidifying strand is shown, since the opposing half is assumed to be a mirror image about this longitudinal axis of symmetry. To predict or estimate the bridging length for a given alloy and casting condition, numerical analysis is carried out for a complex system of heat transfer equations approximating the solidification process to determine the expected locus of the liquidus and solidus isotherms. Typically, the solution thus obtained is then curve-fitted to obtain characteristic parabolic profiles:

$$Y_L = a_1(t)^{0.5} \quad (1)$$

$$Y_s = a_2(t)^{0.5} - a_3 \quad (2)$$

wherein, $Y_L$=depth of the liquidus (cm), $Y_s$=depth of the solidus (cm), t=time from pouring (sec), and $a_i$=curve-fit constants for i=1, 2, 3.

To infer the maximum potential bridging length, first, the above equations are inverted such that time (t) appears as the dependent variable; then inverted Equation (2) is subtracted from inverted Equation (1) with $y_L$ and $y_s$ being set equal to the depth of the centerline, to obtain the following expression:

$$L_B/V = ((b+a_3)/a_2)^2 - (b/a_1)^2 \quad (3)$$

wherein, $L_B$=bridging length (cm),

V=linear casting speed (cm/sec), and b=half-width of casting (cm).

As shown, the bridging length is conveniently referenced (normalized) to the casting speed to express the bridging length equivalently as the time interval along the centerline between the apexes of the liquidus and solidus isotherms.

As a first approximation, however, the bridging length may be estimated from the following relationships (assuming a low superheat as is usual in good casting practice), which are useful in fundamentally understanding the physical process:

$$L_s/V = K_s b^2(1+1/H)^2 \quad (4)$$

$$L_B/L_s = 1-(1-K_B)^2 \quad (5)$$

wherein, $L_s$=solidification length (cm), $K_s$=a first properties constant for the alloy being cast (sec/cm$^2$), $K_B$=a second properties constant for the alloy (dimensionless), H=bh/k=a dimensionless heat transfer constant, being the average heat transfer coefficient from the casting relative to the thermal conductance of the casting, h=the average heat transfer coefficient from the surface of the casting to the coolant (cal/sec.cm$^2$.°C.), and k=the thermal conductivity of the casting (cal/sec.cm.°C.).

The bridging length is seen to vary according to control variables (b, H, V) and according to properties of the alloy ($K_s$,$K_B$). The bridging length is seen to increase linearly with casting speed, to increase with the square of the half-thickness of the strand, and to increase with decreasing heat removal rate. The half-thickness (b) of the strand is fixed, of course, according to the desired cross-sectional size of the casting and therefore is not available as a primary control variable. It is further seen that the bridging length is highly sensitive to the casting speed (V), but relatively insensitive to heat removal rate (H) for commercially reasonable values (i.e. H being substantially greater than 1). The material properties constants are given by the following relationships:

$$K_s = (1+2Q_f/cT_s)/4a \quad (6)$$

$$K_B = (1+1/((1+cT_e/2Q_f)(T_L/T_e-1)))^{-1} \quad (7)$$

wherein, for the solidified shell, a=thermal diffusivity (cm$^2$/sec), $Q_f$=latent heat of fusion (cal/gm), c=specific heat (cal/gm.°C.), $T_L$=the liquidus temperature, less the coolant temperature (°C.), $T_s$=the equilibrium solidus temperature, less the coolant temperature (°C.), and $T_e$=the nonequilibrium temperature below equilibrium solidus at which solidification substantially ends, less the coolant temperature (°C.).

This parameter is fixed, of course, for a given alloy and therefore is not available as a control parameter; however, it is pertinent in the initial specification of a casting system for a particular family of alloys. The second properties constant ($K_B$) is seen to vary between zero and one with low values indicating a low bridging tendency. The bridging length will comprise a significant portion (about 10% or greater) of the solidification length (equation 5) for $K_B$ about 0.05 or greater. The end solidus temperature ($T_e$) may be calculated by numerically intergrating the "nonequilibrium lever rule" (Scheil Equation) considering solidification to be substantially complete when the solid fraction reaches about 95%.

Conditions which tend to increase the bridging length tend to diminish feeding into the solidification apex. As the bridging length is increased, the length of the intermeshed dendritic network along the longitudinal axis of the strand is extended thereby creating a greater restriction to feeding flow of molten alloy. For example, regarding sample castings of steel strand wherein casting conditions were held constant except for carbon content, solidification porosity was seen to substantially increase over the range 0.12% to 0.63% carbon, reflecting increasing dendritic development with increasing freezing range. Furthermore, as this intermeshed network is extended, the number of isolated pockets of molten alloy within this network is statistically likely to increase. Thus, under the condition of restricted feeding along the bridging length, sufficient fresh melt will not be supplied to compensate for solidification shrinkage or to cause mixing of relatively fresh melt with the constitutionally enriched melt building in advance of the solidification front. The adverse effects of this condition are that substantial solidification porosity will be allowed to form and that macrosegregation will not be substantially suppressed.

A companion equation to Equation (5) is given below which is useful in estimating the transverse extent of the dendritic network which in turn is relevant to feeding flow resistance into the solidification zone:

$$L_d/b = K_B(1+1/H) \quad (8)$$

wherein, $L_d$=length of dendrites without turbulent fragmentation (cm), and $L_d/b$=dendritic index.

Thus, the quantity $L_d/b$ indicates the fraction of the width of the strand near the beginning of the bridging zone that is undergoing solidification and therefore is an indication of the extensiveness of or tendency toward dendritic development. As seen from the equation, there are two factors involved, the first being determined by the properties of the alloy being cast and the second being variable according to heat transfer conditions. Thus, by maximizing the heat removal rate, the dendritic index is minimized, thereby indicating diminished feeding flow resistance into the bridging zone. This effect is further discussed below regarding selection of initial conditions in the procedure of the invention.

For purposes herein, the term "minimum macrosegregation" is intended to refer to relatively flat macrosegregation profiles, both transversely and longitudinally, within the solidified strand. In the idealized situation where mixing in the solidification zone is complete such that all liquid throughout is homogenous in composition, a condition of dynamic equilibrium will exist during steady-state continuous casting, as represented by the following equations:

$$C_L = C_o/K_c \quad (9)$$

$$C_s = C_o \quad (10)$$

wherein, $C_o$=alloying concentration of the molten feed, $K_c$=partition ratio for the solidifying alloy, $C_L$=alloying concentration within the liquid in the solidification zone, and $C_s$=concentration within the solid in the vicinity of the solidification front.

Since the advancing front is everywhere in contact with this idealized homogeneous melt, the solid growing therefrom will be of constant concentration equal to the feed concentration. Therefore the macrosegregation profile will be flat, both transversely and longitudinally. This ideal, however, could likely not be perfectly achieved; nevertheless, in some situations, it may be approached sufficiently close such that a practical lower limit has been reached. It can be determined that this lower limit has been reached when the transverse macrosegregation index at substantially any axial location is not significantly greater than the statistical variation induced in the macrosegregation profile by statistical variation (random perturbations) about nominal in the process variables (including feed concentration) further considering statistical errors of measurement (including analysis errors in determining the macrosegregation profile). Restated, if the macrosegregation index (being the maximum absolute variance in the profile of same) is not "statistically distinct" considering statistical noise of the casting operation and statistical error in measurement of the pertinent variables, then the idealized macrosegregation profile has been substantially attained. This necessarily implies that the axial macrosegregation profile will also be substantially flat. The transverse profile provides a history of the solidification zone in its axial extent, since any given point on a traverse section was at one time in the vicinity of the solidification front. Therefore, a relatively flat transverse profile implies that liquid throughout the solidification zone was substantially uniform in composition (i.e. that good mixing existed throughout the liquid thereby providing a liquid of substantially constant composition near the front) such that a state of dynamic equilibrium existed substantially uniformly along the axial extent of the solidification zone.

For purposes herein, the term "alloy" is intended to include metals of commercial purity since the presence of impurities is in effect equivalent to the presence of alloying elements. Furthermore, the term is intended to include pure metals since pure metals frequently undergo dendritic solidification. However, even with nondendritic solidification, feeding flow may be restricted simply by the narrowing of the solidification zone in the vicinity of the solidification apex. The foregoing discussion is generally applicable to metals concerning the solidification porosity aspect by considering the liquidus temperature ($T_L$) as simply the melting point and the nonequilibrium solification temperature ($T_e$) as corresponding to the extent of supercooling where the solidification front forms under a given set of casting conditions, since pure metals undergoing solidification typically require substantial supercooling before solidification proceeds at an appreciable rate.

For purposes herein, the term "strand" is used generically to refer to elongated uniform castings without regard to their transverse cross-sectional shape and thus comprehends a variety of transverse cross-sections such as square, trapezoidal, elliptical, and the like.

In wheel-type continuous casting, a stream of molten alloy is directed from a nozzle into a chill channel in the outer periphery of a vertically rotating casting wheel or ring, the channel being enclosed by a flexible band urged against and cooperatively rotating with the periphery of the wheel. Cooling sprays are directed against the outside of the chill channel and the closure band to extract the heat from the molten stream thereby forming a solidified advancing strand of indefinite length which is continually directed from an exit point on the wheel to accumulating apparatus. A representative example of a wheel caster is disclosed in U.S. Pat. No. 3,279,000 (10/66). Solidification may optionally be completed off-wheel wherein the strand is directed from the chill channel before solidification is complete. Representative examples of off-wheel solidification in continuous casting and attendant considerations are disclosed in U.S. Pat. Nos. 3,734,162 (5/73) and 3,774,669 (11/73).

Figure 2:
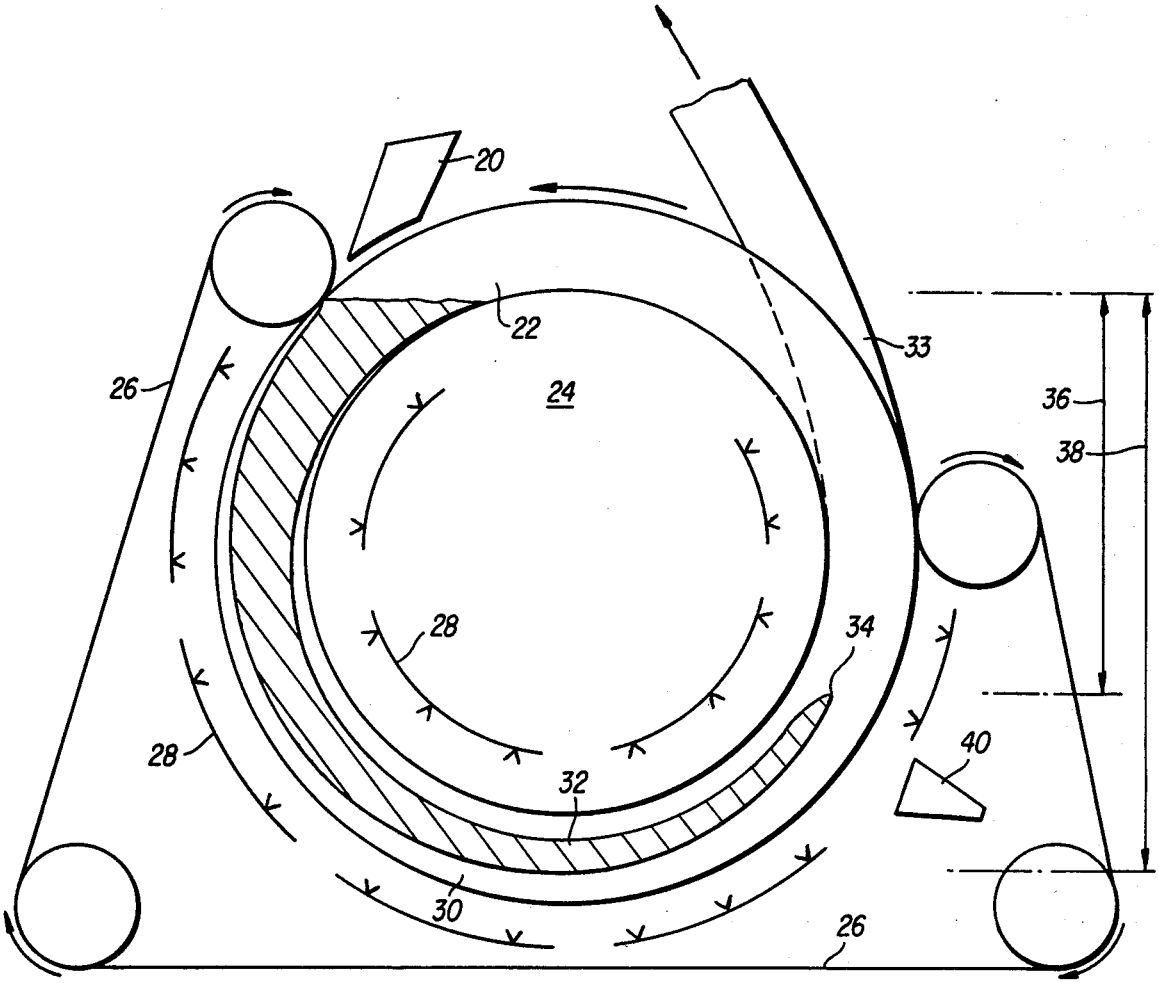
FIG. 2 is a schematic depiction of a wheel-type continuous casting operation indicating the solidification zone within the advancing strand.

In FIG. 2, there is schematically depicted a wheel-type continuous casting operation indicating the solidification zone in cutaway fashion within the advancing strand in the chill channel. Molten alloy is supplied from a furnace (not shown) to a nozzle 20 (typically located at about 45° from the 12 o'clock position) whereby a molten stream is directed into a chill channel 22 or groove machined in the outer periphery of a casting wheel 24, rotating substantially in a vertical plane. The meniscus of the molten alloy is contained in the chill channel by a closure band 26 cooperatively rotating against the wheel periphery through an arc sufficiently extensive to provide support of the nascent strand. Cooling sprays 28 (shown generally) are directed against the outside of the chill channel and the closure band. As solidification of the molten stream proeeds, a solidified shell 30 forms about the periphery of the molten stream and thickens progressively to contain the molten core 32 of the nascent strand 33. This molten core generally has the shape of an elongated arcuate cone extending deeply into the forming strand. At the apex 34 of the solidification zone, solidification is complete. The metalostatic pressure at any location in the molten core is determined by the vertical distance below the meniscus of the molten pool at pouring. Thus, elevation 36 indicates the metalostatic pressure head in the vicinity of the solidification apex, while elevation 38 indicates the maximum static pressure head at the 6 o'clock wheel position. The relative location of the solidification apex remains constant for constant casting conditions but will shift in location as conditions are changed. For example, if casting speed is increased, the apex will shift in the direction of casting thereby elongating the solidification zone. Changes in the heat removal rate (coolant conditions) have a reciprocal effect such that a decrease in heat removal rate elongates the solidification zone.

The existence of solidification porosity within the solidified strand is monitored downcourse of the solidification apex at 40 for example. This monitoring of internal structure is done by conventional techniques for nondestructive scanning, such as by radiographic devices. A review of nondestructive scanning techniques is given in the article by H. Berger, "Nondestructive Testing", 118:3 Metal Progress 33 (1980). Alternatively, the location of such monitoring may be located downcourse of the exit point of the strand from the chill channel or immediately downcourse of the solidification apex. In the first monitoring mode, there is the advantage that the strand surface is exposed thereby allowing direct scanning of the strand without attenuation through components of the caster and thereby enhancing detectability of porosity. However, the disadvantage of this monitoring mode is that a time delay will be introduced into the control system equal to the time interval downcourse from the solidification apex. Thus, it is preferred to minimize this downcourse distance.

In the second monitoring mode wherein porosity is monitored immediately downcourse of the solidification apex (as shown), preferably apex monitoring and porosity monitoring are done by the same scanner. The location of the monitor is movable so that the monitor may be readily moved for changes in location of the solidification apex with changing casting conditions. Preferably the location and scanning of the monitor is controlled automatically using a conventional servomechanism directed by an appropriately programmed process computer so that the monitor "lock" onto and follows the apex.

In operation, first, a condition of steady-state continuous casting is established, with cooling set substantially at maximum as discussed above in connection with Equation (8). The location of the solidification apex is determined; and, if necessary, casting speed is increased until the apex is located downcourse of the 6 o'clock wheel position. Then, the existence of solidification porosity downcourse of the apex is determined. There are two possibilities such that either porosity will be present, as detectable at a given resolution, or porosity will not be present. If porosity is present, a condition of discontinuous feeding into the apex exists, i.e. flow restriction into the apex is too great. Accordingly, casting speed is decreased to contract the solidification length (and therefore the bridging length, according to Equation (5)) until the rate of formation of solidification porosity is first minimized; provided, however, that if the apex has been shifted substantially to the 6 o'clock wheel position without achieving this minimum, then cooling is decreased sufficiently to shft the apex downcourse of the 6 o'clock position by a selected distance, and then repeating this entire step. Restated, the optimizing search must be reinitialized and restarted if the apex moves to a location where the direction of increasing metalostatic pressure is not counter to the direction of casting. If reinitialization is required, the cooling decrement is selected to shift the apex significantly, but not excessively, downcourse of 6 o'clock, since it is desirable to maintain cooling at as high a rate as possible and to provide sufficient skin thickness in this region of high static pressure to prevent "breakouts" of the molten core. Thus, eventually the optimum point of operation will be determined such that casting rate is substantially maximized subject to product quality regarding minimum porosity and macrosegregation. Depending on the fixed parameters of the casting system, such as type alloy, wheel radius, and cooling capacity, this minimum porosity may be substantially zero. Operating conditions are then maintained within a tolerance band of selected width relative to optimum, corresponding to a level of perturbation in the process variables within which control is inactive as required for control stability. This tolerance band may be skewed below optimum such that product quality is not significantly changed from optimum while control is inactive. Conversely, given the alternative initial situation where solidification porosity is not present, casting speed is increased until porosity formation impends, thereby approaching the optimum point of operation from an initial condition of less than optimum.

Figure 3:
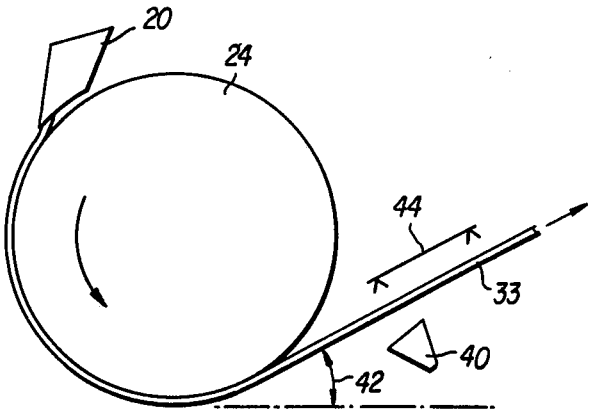
FIG. 3 is a schematic depiction of an alternative configuration wherein solidification is completed off-wheel.

It is noted that there will be a compound response in the solidification zone to any shift in the solidification apex thereby promoting control sensitivity. For example, in the situation where porosity is forming, a decrease in casting speed not only shortens the bridging length but also moved the apex to a location of higher metalostatic pressure. Thus, when casting speed is decremented, feeding pressure is increased and resistance to feeding is decreased. Conversely, in the alternative situation where porosity is not forming, an increase in casting speed lengthens the bridging zone and moves the apex to a location of lower pressure. Thus, when casting speed is incremented, feeding pressure is decreased and resistance to feeding is increased. In an optional operating configuration, as depicted in FIG. 3, the partially solidified strand 33 is directed from the chill channel 22 just downcourse of the 6 o'clock position at a selected upward inclination angle 42. Since the rate of change of metalostatic feeding pressure into the solidification apex with change in apex position (elevation) is proportional to the sine of the inclination angle, control responsiveness may be selectively varied according to this inclination. In this configuration, secondary cooling sprays 44 are preferablay provided.

There are further advantageous effects in connection with operating downcourse of the 6 o'clock wheel position which arise from the reversal in the pull of gravity relative to the direction of casting as the molten stream passes through the 6 o'clock position. These advantageous effects promote fragmentation of the dendrites and turbulent mixing in the solidification zone. One such effect concerns the reversal in convective circulation within the molten core about the 6 o'clock position, as was disclosed by H. Chia and R. Adams in a technical presentation before the 108th AIME Annual Meeting on Feb. 18, 1979, which will tend to promote fragmentation or shearing of dendrites extending from the solidification front. Such fragmentation will tend to diminish feeding resistance into the solidification apex. Further, this reversal in the convective circulation pattern promotes turbulent mixing in the molten core. Another advantageous effect arises from the gravitational pull of dendrite fragments away from the solidification apex thereby tending to prevent fragment clustering in the vicinity of the apex. Another advantageous effect promoting turbulent mixing arises since convection in the molten core is predominately counter to the casting direction thereby augmenting the anticlustering effect.

Though it is preferred to practice the invention in a continuous and automatic fashion as described above, it may also be practiced manually wherein each scan of the automatic monitor is replaced by a manual procedure in the search routine. To determine the location of the solidification apex, the temperature profile is measured in the molten core of the strand, as for example by inserting the sensing junction of a thermocouple into the meniscus of the molten alloy at the pouring location such that the thermocouple leads are captured between the closure band and the chill channel periphery and are directed to a data processor. By plotting thermocouple output versus elapsed time from the pouring location and noting the time required for complete solidification (i.e. the point at which the slope of temperature changes to steeply negative), the solidification time interval is determined which corresponds to the location of the solidification apex. Solidification porosity is then sampled along the solidified strand as it exits the chill channel, as for example by conventional ultrasonic techniques. Each repetition of this manual procedure is equivalent to a single scan of an automatic monitor and, thus, must be repeated a number of times according to the overall procedure of the invention. Once the optimal operating condition is established, it is preferred that final operating conditions be established below optimum by a selected tolerance margin to allow for anticipated random perturbations in the process variables to the extent desired, since monitoring and control are not continuous.

In addition to the application of the method of the invention to the operation of existing casters, it may be advantageously applied in the designs of new casting systems. For example, given certain specified parameters, such as casting thickness, nominal production rate, and type alloy, the remaining parameters, such as wheel radius and maximum cooling rate are then specified such that the solidification apex will be nominally located downcourse of the 6 o'clock wheel position, i.e. such that the solidification length (generally equation 4) extends along the wheel periphery beyond the 6 o'clock position. A relatively long solidification length will generally imply that a relatively large wheel radius is required for both high metalostatic pressure (maximum at the 6 o'clock position) and a long residence arc along the wheel periphery.

While preferred embodiments of the invention have been illustrated and described, it will be recognized by those skilled in the art that the invention may be otherwise variously embodied and practiced within the scope of the following claims.

What is claimed is:

1. A method for optimally operating a wheel-type continuous caster, such that solidification porosity and macrosegregation in the continuous strand thus produced is substantially minimized while casting rate is substantially maximized, comprising the steps:

(a) first, establishing operation of said caster at a condition of steady-state continuous casting, with cooling set at substantially maximum capacity to produce an apex of solidification at a location where the casting completely solidifies;

(b) monitoring the location of the apex of the solidification zone within the solidifying strand being cast;

(c) if said solidification apex is not located downcourse of the lowermost wheel position, then increasing casting speed until the apex is located downcourse of the lowermost wheel position;

(d) monitoring the presence of solidification porosity within said strand downcourse of said solidification apex;

(e) adjusting casting conditions according to the criteria:

(i) if porosity is present, decrease casting speed so as to shift said apex counter to the direction of casting and in the direction of increasing metalostatic pressure until formation of solidification porosity is substantially minimized; further provided that if said apex has been shifted substantially to the lowermost wheel position without achieving said minimization, then decreasing cooling sufficiently to shift said apex downcourse of the lowermost position by a selected distance and then repeating the procedure of this substep; or (ii) if porosity is not present, increase casting speed so as to shift said apex in the direction of casting until formation of porosity impends; and (f) maintaining casting conditions within a desired porosity tolerance range about said adjusted conditions.

2. The method of claim 1 wherein solidification porosity is monitored immediately downcourse of said solidification apex.

3. The method of claim 1 wherein the cast material has a relatively high tendency toward dendritic development during solidification.

4. The method of claim 3 wherein said material has a relatively large freezing range.

5. The method of claim 1 wherein the radius of the casting wheel is selected so that the solidification apex is located downcourse of the lowermost wheel position during nominal casting conditions.

6. The method of claim 1 wherein the partially solidified strand is directed from the casting wheel downcourse of the lowermost wheel position at a selected upward inclination angle.

7. A method for optimally operating a wheel-type continuous caster, such that solidification porosity and macrosegregation in the continuous strand thus produced is substantially minimized while casting rate is substantially maximized, comprising the steps:

(a) first, establishing operation of said caster at a condition of steady-state continuous casting, with cooling set at substantially maximum capacity to produce an apex of solidification at a location where the casting compeletly solidifies;

(b) monitoring the location of the apex of the solidification zone within the solidifying strand being cast;

(c) if said solidification apex is not located downcourse of the lowermost wheel position, then increasing casting speed until the apex is located downcourse of the lowermost wheel position;

(d) monitoring the presence of solidification porosity within said strand downcourse of said solidification apex;

(e) controlling casting conditions according to the criteria:

(i) if porosity is present, decrease casting speed so as to shift said apex counter to the direction of casting and in the direction of increasing metalostatic pressure until formation of solidification porosity is substantially minimized; further provided that if said apex has been shifted substantially to the lowermost wheel position without achieving said minimization, then decreasing cooling sufficiently to shift said apex downcourse of the lowermost position by a selected distance and then repeating the procedure of this substep; or (ii) if porosity is not present, increase casting speed so as to shift said apex in the direction of casting until formation of porosity impends; and (f) controlling casting conditions within a desired porosity tolerance range about said conditions.

* * * * *